US009447342B2

(12) United States Patent
Dietz et al.

(10) Patent No.: US 9,447,342 B2
(45) Date of Patent: Sep. 20, 2016

(54) LOW TEMPERATURE STABLE FATTY ACID COMPOSITION

(75) Inventors: Jeffry G. Dietz, Shaker Heights, OH (US); Warren R. Pistillo, Chesterland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 1754 days.

(21) Appl. No.: 12/095,048

(22) PCT Filed: Nov. 29, 2006

(86) PCT No.: PCT/US2006/061314

§ 371 (c)(1),
(2), (4) Date: Sep. 29, 2008

(87) PCT Pub. No.: WO2007/076203

PCT Pub. Date: Jul. 5, 2007

(65) Prior Publication Data

US 2009/0217572 A1 Sep. 3, 2009

Related U.S. Application Data

(60) Provisional application No. 60/741,668, filed on Dec. 2, 2005.

(51) Int. Cl.

| | |
|---|---|
| ***C10L 1/18*** | (2006.01) |
| ***C10L 1/14*** | (2006.01) |
| ***C10L 1/182*** | (2006.01) |
| ***C10L 1/188*** | (2006.01) |
| ***C10L 1/224*** | (2006.01) |
| *C10L 1/16* | (2006.01) |

(52) U.S. Cl.

CPC ..... *C10L 1/14* (2013.01); *C10L 1/1824* (2013.01); *C10L 1/1881* (2013.01); *C10L 1/224* (2013.01); *C10L 1/1616* (2013.01)

(58) Field of Classification Search

CPC ..... C10L 1/14; C10L 1/1616; C10L 1/1824; C10L 1/1881; C10L 1/224

USPC ..... 44/331, 386, 402, 408, 411, 385

See application file for complete search history.

(56) References Cited

U.S. PATENT DOCUMENTS

| | | | | |
|---|---|---|---|---|
| 2,907,646 | A | 10/1959 | O'Kelly et al. | |
| 5,279,626 | A * | 1/1994 | Cunningham et al. | 44/331 |
| 5,968,211 | A * | 10/1999 | Schilowitz | 44/402 |
| 5,993,497 | A * | 11/1999 | Cherpeck et al. | 44/347 |
| 6,277,158 | B1 | 8/2001 | McLean | |
| 6,280,485 | B1 * | 8/2001 | Daly et al. | 44/301 |
| 7,182,795 | B2 * | 2/2007 | Henly et al. | 44/331 |
| 7,402,186 | B2 * | 7/2008 | Spivey et al. | 44/412 |
| 7,901,471 | B2 * | 3/2011 | Spivey et al. | 44/412 |
| 2003/0221362 | A1 * | 12/2003 | Collier et al. | 44/363 |
| 2004/0055678 | A1 * | 3/2004 | Hales et al. | 149/109.6 |
| 2005/0139174 | A1 * | 6/2005 | Cleveland et al. | 123/1 A |

FOREIGN PATENT DOCUMENTS

| | | | |
|---|---|---|---|
| EP | 0626442 | B1 | 11/1994 |
| EP | 0829527 | A1 | 3/1998 |
| EP | 0789460 | B1 | 5/2001 |
| EP | 0938533 | B1 | 11/2001 |
| WO | 2005066317 | A1 | 7/2005 |

OTHER PUBLICATIONS

Search Report of corresponding PCT application No. PCT/US2006/061314 mailed Jul. 4, 2007.

* cited by examiner

*Primary Examiner* — Latosha Hines

(74) *Attorney, Agent, or Firm* — Iken S. Sans; Teresan W. Gilbert

(57) ABSTRACT

The present invention related to a fuel additive package for a low-sulfur diesel fuel made up of specific grades of fatty acids higher in di-unsaturated fatty acids such as linoleic acid blended in an aromatic solvent and a compatibilizer mixture which consists of low molecular weight alcohols and low molecular weight acylated nitrogen compound, which is the reaction product of alkyl succinic anhydride and an alkanolamine.

12 Claims, No Drawings

LOW TEMPERATURE STABLE FATTY ACID COMPOSITION

BACKGROUND OF THE INVENTION

The present invention relates to a homogenous additive composition containing a tall oil fatty acid, compatibilizer mixture and an aromatic solvent for use in a diesel fuel composition.

The sulfur content of diesel fuel is being lowered in a number of countries for environmental reasons. In the United States, ultra low sulfur diesel fuel will be mandated to have less than 15 ppm of sulfur by June of 2006. The process for preparing low sulfur content fuels in addition to reducing sulfur content also reduces the content of other components of the fuel such as polyaromatic components and polar components. It has been found, that reduction of these components has decreased the lubricity of the fuel. In some diesel engines, the fuel is the lubricant for the fuel system components, such as fuel pumps and injectors. Thus, the decreased lubricity of the ultra low sulfur diesel fuel has resulted in the fuel being less efficient in lubricating fuel system, especially the injection system.

This wear problem associated with low sulfur content diesel fuel can be reduced by providing a lubricity additive to the fuel composition. One such additive that has shown to provide wear reducing properties to low sulfur diesel fuel is tall oil fatty acid (see U.S. Pat. No. 2,907,646.) Most fuels are additized by injecting the additive into the fuel while it is being loaded into trucks at the terminal rack, or at the pipeline flange as the fuel is received at the terminal. The additive solution must be fluid, homogeneous and low viscosity this can be accomplished by formulating compositions to have low viscosity and compatibility at low temperature. Unfortunately, an additive such as tall oil fatty acid is not suitable as the sole component since it typically turns solid at 0° C. within one day.

EP 0789460A1 and U.S. Pat. No. 5,968,211 discloses an additive concentrate containing solubilizers to maintain the concentrate in the liquid state at low temperatures. Fatty acid, oligomers of such acids and the esters of such acids, useful as anti-friction and wear reducing additives in gasoline and diesel fuels are formulated into an additive concentrate which remains liquid at low temperatures of about −17° C. and lower by the additional presence in the concentrate of an alcohol, an amine, or a mixture of alcohol and amine. The fatty acids and their esters are typically derived from naturally occurring oils and include those known as tall oil acids and their esters.

EP0938533B1 and U.S. Pat. No. 6,277,158 discloses an additive concentrate for use in fuels, especially in gasoline for internal combustion engines. The invention provides an additive concentrate comprising by weight an ashless friction modifier which is liquid at room temperature and pressure selected from i) n-butylamine oleate or derivatives thereof, (ii) a substance comprising tall oil fatty acid or derivatives thereof, and (iii) a mixture of (i) and (ii) a deposit inhibitor, and a carrier fluid. Solubilizing agents for example hydrocarbon solvents such as alcohol may be included.

EP0829527A1 discloses an additive concentrate for use in fuels, especially in gasoline for internal combustion engines an ashless friction modifier which is liquid at room temperature and pressure selected from i) n-butylamine oleate or derivatives thereof, and (ii) a substance comprising tall oil fatty acid or derivatives thereof, and (iii) a mixture of (i) and (ii) a deposit inhibitor, and a carrier fluid.

WO 05/066317A1 discloses an invention to provide fuel lubricity compositions that improve lubricity over conventional additives. The invention provides a composition which contains corrosion inhibitors and/or stability additives along with lubricity additives are useful as fuel lubricity aids. The lubricity additives selected from ester-based additives and amide-based lubricity additives. The corrosion inhibitors selected from mono, dimer and trimer acids, succinic acids, imidazolines and stability additives selected from hindered primary, secondary and tertiary amines, amides, amine/aldehyde condensates and mixtures thereof.

The present invention, therefore, solves the problem of providing storage stability to the fuel, while maintaining lubricity by using an fuel additive package made up of specific grades of fatty acids higher in di-unsaturated fatty acids such as linoleic acid blended in an aromatic solvent and a compatibilizer mixture which consists of low molecular weight alcohols and low molecular weight acylated nitrogen compound, which is the reaction product of alkyl succinic anhydride and an alkanolamine. This fuel additive package containing the tall oil fatty acid, compatizer mixture and aromatic solvent can be kept homogeneous and have low viscosity at temperatures as low as −29° C.

SUMMARY OF THE INVENTION

The present invention provides for a homogenous additive composition comprising:

(a) fatty acid;

(b) a compatibilizer mixture; and (c) an aromatic solvent wherein the fatty acid has a monounsaturated fatty acid content of less than about 45% by weight;

wherein the compatibilizer mixture comprises a mixture of a 1 to about 10 carbon atom alcohol and the reaction product of a low molecular weight alkyl succinic anhydride and an alkanolamine;

wherein the additive composition has kinematic viscosity of less than 100 $mm^2/s$ at −29° C.

The present invention provides for a fuel composition comprising:

(a) a liquid fuel;

(b) fatty acid;

(c) a compatibilizer mixture; and (d) an aromatic solvent wherein the fatty acid has a monounsaturated fatty acid content of less than about 45% by weight;

wherein the compatibilizer mixture comprises a mixture of a 1 to about 10 carbon atom alcohol and the reaction product of a low molecular weight alkyl succinic anhydride and an alkanolamine;

wherein the additive composition has kinematic viscosity of less than 100 $mm^2/s$ at −29° C.

The present invention provides a method of fueling an engine comprising:

(a) supplying to said engine:

(i) a liquid fuel, (ii) fatty acid;

(iii) a compatibilizer mixture; and (iv) an aromatic solvent wherein the fatty acid has a monounsaturated fatty acid content of less than about 45% by weight;

wherein the compatibilizer mixture comprises a mixture of a 1 to about 10 carbon atom alcohol and the reaction product of a low molecular weight alkyl succinic anhydride and an alkanolamine;

wherein the additive composition has kinematic viscosity of less than 100 $mm^2/s$ at −29° C.

DETAILED DESCRIPTION OF THE INVENTION

Various preferred features and embodiments will be described below by way of non-limiting illustration.

The additive composition of the present invention useful for a spark or a compression ignition internal combustion engine comprises a tall oil fatty acid, a compatibilizer mixture and an aromatic solvent.

Fuel

The composition of the present invention can comprise a fuel which is liquid at room temperature and is useful in fueling an engine. The fuel is normally a liquid at ambient conditions e.g., room temperature (20 to 30° C.). The fuel can be a hydrocarbon fuel, a nonhydrocarbon fuel, or a mixture thereof. The hydrocarbon fuel can be a petroleum distillate to include a gasoline as defined by ASTM specification D4814 or a diesel fuel as defined by ASTM specification D975. In an embodiment of the invention the fuel is a gasoline, and in other embodiments the fuel is a leaded gasoline, or a nonleaded gasoline. In another embodiment of this invention the fuel is a diesel fuel. The hydrocarbon fuel can be a hydrocarbon prepared by a gas to liquid process to include for example hydrocarbons prepared by a process such as the Fischer-Tropsch process. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, methyl t-butyl ether, methyl ethyl ketone, transesterified oils and/or fats from plants and animals such as rapeseed methyl ester and soybean methyl ester, and nitromethane. In several embodiments of this invention the fuel can have an oxygenate content on a weight basis that is 1 percent by weight, or 10 percent by weight, or 50 percent by weight, or up to 85 percent by weight. Mixtures of hydrocarbon and nonhydrocarbon fuels can include, for example, gasoline and methanol and/or ethanol, diesel fuel and ethanol, and diesel fuel and a transesterified plant oil such as rapeseed methyl ester. In an embodiment of the invention, the liquid fuel can be an emulsion of water in a hydrocarbon fuel, a nonhydrocarbon fuel, or a mixture thereof. In several embodiments of this invention the fuel can have a sulfur content on a weight basis that is 5000 ppm or less, 1000 ppm or less, 300 ppm or less, 200 ppm or less, 30 ppm or less, or 10 ppm or less. In another embodiment, the fuel can have a sulfur content on a weight basis of 1 to 100 ppm. In one embodiment, the fuel contains 0 ppm to 1000 ppm, or 0 to 500 ppm, or 0 to 100 ppm, or 0 to 50 ppm, or 0 to 25 ppm, or 0 to 10 ppm, or 0 to 5 ppm of alkali metals, alkaline earth metals, transition metals or mixtures thereof. In another embodiment, the fuel contains 1 to 10 ppm by weight of alkali metals, alkaline earth metals, transition metals or mixtures thereof. It is well known in the art that a fuel containing alkali metals, alkaline earth metals, transition metals or mixtures thereof have a greater tendency to form deposits and therefore foul or plug injectors. The fuel of the invention can be present in a fuel composition in a major amount that is generally greater than 50 percent by weight, and in other embodiments is present at greater than 90 percent by weight, greater than 95 percent by weight, greater than 99.5 percent by weight, or greater than 99.8 percent by weight.

Fatty Acid

The fatty acid may be saturated or unsaturated, wherein the unsaturated fatty acid can include mono, di, and/or poly unsaturated fatty acids. Useful $C_{14}$ to $C_{22}$ fatty acids are those of the formula R—COOH where R is hydrocarbyl group which are associated with the fatty acid moiety groups in the range of $C_{14}$ to $C_{22}$. The hydrocarbyl group is described such that the corresponding acid (R—COOH) is characterized by $C_{(n,m)}$ where n is the number of carbon atoms in the acid and n is in the range of 14 to 22 with the notation as $C_{(n,m)}$ and m is the degree of unsaturation and m is in the range of 0 to 4. Typical useful fatty acids include: oleic($C_{(18,1)}$), stearic($C_{(18,0)}$), palmitic($C_{(16,0)}$), myristic ($C_{(14,0)}$), myristoleic($C_{(14,1)}$), palmitoleic($C_{(16,1)}$), margaric ($C_{(17,0)}$), margaroleic($C_{(17,1)}$), linoleic($C_{(18,2)}$), linolenic ($C_{(18,3)}$), arachidic($C_{(20,0)}$), gadoleic($C_{(20,1)}$), eicosadienoic ($C_{(20,2)}$), behenic($C_{(22,0)}$), erucic($C_{(22,1)}$), and the acids from the natural products tallow, soybean oil, palm oil, olive oil, peanut oil.

In one embodiment the fatty acid contains less than about 45% by weight of a monounsaturated fatty acid, in other embodiments less than about 40% by weight or less than 35% by weight or less than 30% by weight or less than 20% by weight. In yet another embodiment, the fatty acid contains less than about 10 to about 45% by weight of a monounsaturated fatty acid.

In one embodiment, the fatty acid can contain less than about 20% by weight of a saturated fatty acid. In another embodiment, the fatty acid can contain less than about 15% by weight or less than 10% by weight or less than 5% by weight or less than 2% by weight of a saturated fatty acid. In yet another embodiment, the fatty acid contains about 1% to about 10% by weight of a saturated fatty acid.

In one embodiment, the fatty acid can be a tall oil fatty acid, which is a mixture of naturally occurring fatty acids that are refined from Tall Oil, which is a mixture of saturated and unsaturated fatty and rosin acids (that is, $C_{14}$ to $C_{22}$ fatty acids or mixtures thereof), which is obtained in paper pulp manufacture when the pulping is done by the sulfate process. Tall Oil is further separated into Tall Oil heads and Tall Oil Fatty acid. Tall oil fatty acids (TOFA) are a mixture of fatty acids predominately oleic and linoleic and contain residual rosin acids.

In one embodiment, of the present invention the tall oil fatty acid can have an oleic acid ($C_{(18,1)}$) content of less than about 45% by weight, in another embodiment less than about 40% by weight, in another embodiment less than 35% by weight, in another embodiment less than 30% by weight, in another embodiment less than 25% by weight, in another embodiment less than 20% by weight, in another embodiment less than 15% by weight.

In another embodiment, the R groups of the fatty acid may contain more than one degree of unsaturation in the form of carbon carbon double bonds, examples of such fatty acids include linoleic($C_{(18,2)}$) or linolenic($C_{(18,3)}$).

In one embodiment, the R groups containing more than one degree of unsaturation can be greater than 45% by weight or greater than 50% by weight or greater than 56% by weight.

In one embodiment, the tall oil fatty acid has an oleic acid content less than 45% by weight, in another embodiment less than about 40% by weight, in another embodiment less than 35% by weight, in another embodiment less than 30% by weight, in another embodiment less than 25% by weight, in another embodiment less than 20% by weight, in another embodiment 15% by weight and a linoleic content of greater than 45% by weight or greater than 50% by weight or greater than 56% by weight.

In one embodiment, the fatty acid can be present in the homogenous additive composition from about 10% to about 90% by weight. In another embodiment, the fatty acid can be present in the homogenous additive composition from about 20% to about 85% by weight or from about 25% to about 75% by weight or from about 25% to about 50% by weight.

Compatibilizer Mixture

The compatibilizer mixture of the present invention can contain a mixture of 1 to about 10 carbon atom alcohol and low molecular weight acylated nitrogen compound, which is the reaction product of alkyl succinic anhydride and an alkanolamine present in a ratio of 1:10 to 10:1, 1:5 to 5:1, 3:5 to 5:3, 1:2 to 2:1, 1:1.

The $C_{1-10}$ alcohol of the compatibilizer mixture can be saturated, unsaturated, branched, linear, cyclo or mixtures thereof. The hydroxyl group of the C1-10 alcohol can be primary, secondary, tertiary or mixtures thereof. Additionally, the C1-10 alcohol can be a mono, di, or polyol. Examples of the alcohols of the compatilizer mixture can include cis-2-buten-1-ol, 2-butoxyethanol, 2-ethylhexanol, 3-heptanol, 3-pentanol, 3,3-dimethyl-1-butanol, 2,5-hexanediol, 2-hexanol, 1-hexanol, 1-heptanol, 2-octanol, trans-2-buten-1-ol, 4-methyl-2-pentanol, 2-methyl-1-pentanol, isodecyl alcohol, isooctyl alcohol, or mixtures thereof.

The acylated nitrogen compound of the present invention is the reaction product of an alkyl succinic anhydride or its acid or ester derivative and an alkanolamine. The alkyl group of the alkyl succinic anhydride can be a hydrocarbyl group containing from about 4 to about 18 carbon atoms; from about 6 to about 18 carbon atoms, from about 9 to about 18 carbon atoms and particularly from about 12 to about 18 carbon atoms. The alkyl group of the alkyl succinic anhydride can be saturated, unsaturated, branched, linear or mixtures thereof.

The alkyl succinic anhydride can be the reaction product of a branch or linear olefin having about 4 to about 18 carbon atoms; from about 6 to about 18 carbon atoms, from about 9 to about 18 carbon atoms and particularly from about 12 to about 18 carbon atoms and maleic anhydride. This reaction is well known to those skilled in the art.

Alkanolamine component of the acylated nitrogen compound of the present invention can be amino alcohols, such as, an ethanolamine (including mono, di and tri ethanolamines), or a propanol amines (including mono, di and tri ethanolamines) in which nitrogen is attached directly to the carbon of the alkyl alcohol. Examples of the alkanolamine component of the acylated nitrogen compounds can include: monoethanolamine, triethanolamine, methylethanolamine, methyldiethanolamine, dimethylethanolamine, diethylethanolamine, dibutylethanolamine, monoisopropanolamine, diisopropanolamine, triisopropanolamine. The examples of these alkanolamines are well known to those skilled in the art.

The reaction products of the alkyl succinic anhydride or its acid or ester derivative and the alkanolamine include amides, imides, esters, amine salts, ester-amides, ester-amine salts, amide-amine salts, acid-amides, acid-esters and, mixtures thereof. The reaction and the resulting products of the alkyl succinic anhydride and the alkanolamine are readily known to those skilled in the art.

In one embodiment, the compatibilizer mixture can be present in the additive composition from about 0.1% to about 20% by weight, in another embodiment from about 1% to about 15% by weight, or from about 2% to about 10% by weight, or from about 3% to about 8% by weight.

Aromatic Solvent

Another component of the present invention can be an aromatic solvent or other diluent. In one embodiment, the aromatic solvent or other diluent can be benzene, toluene, xylene, or mixtures thereof. Examples of commercially available aromatic solvents or diluents include from Shell Chemical Shellsolv AB™ and from Exxon Chemical the Aromatic™ series of solvents Aromatic™ 100, Aromatic™ 150 and Aromatic™ 200, the Solvesso™ series of solvents Solvesso™ 100, Solvesso™ 150 and Solvesso™ 200, and HAN™ 857.

In one embodiment, the aromatic solvent or diluent, may have an aromatic content of greater than 40% by weight, or 50% by weight, or 60% by weight, or 70% by weight, or 80% by weight.

In one embodiment, the aromatic solvent can be present in the additive composition from about 10% to about 95% by weight. In another embodiment, from about 20% to about 90% by weight, or from about 35% to about 85% by weight, or from about 35% to about 75% by weight, or from about 40% to about 70% by weight.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Miscellaneous

The homogenous additive compositions of the present invention will inherently have a kinematic viscosity as measure by ASTM D445 of less than 100 $mm^2/s$ at −29° C., or less than 75 $mm^2/s$ at −29° C., or less than 50 $mm^2/s$ at −29° C.

EXAMPLES

The invention will be further illustrated by the following examples, which set forth particularly advantageous embodiments. While the examples are provided to illustrate the present invention, they are not intended to limit it.

The additive compositions are evaluated in the storage stability test. The storage stability test procedure is as follows. Approximately 50 grams of the fuel additive concentrates samples are placed in glass vials and stored at the following temperatures: 0° C., −8° C., −29° C., and −40° C. for up to 21 days. The samples are visual inspected and rated per the table below on a weekly basis. The result of this test can be found in Tables 1 and 2.

| Storage Stability Rating Table | |
|---|---|
| Z | Hazy |
| SLZ | Slightly Hazy |
| S | Solid |
| H | Heavy Sediment |
| M | Medium Sediment |
| L | Light Sediment* |
| T | Trace Sediment** |
| Q | Separation |
| F | Flocculent**** |
| N | Suspension*** |

*Thin layer of film of sediment less than 1/16 of an inch
**Layer of sediment greater than 1/16 of an inch
***Wispy appearances suspended in blend
****Snowflake-like appearances in blend Sample 1 is a commercially available tall oil fatty acid with a pour point of −6° C. containing 47.3% by weight of oleic acid, 41.5% by weight of linoleic acid, 2.2% by weight of stearic acid with the remainder of the composition making up various other fatty acids. Sample 2 is a commercially available tall oil fatty acid with a pour point of −9° C. containing 27.3% by weight of oleic acid, 56.4% by weight of linoleic acid, 1.1% by weight of stearic acid with the remainder of the composition making up various other fatty acids. The fatty acids compositions of Samples 1 and 2 is measured by ASTM D5974.

The following formulations are prepared, where the amounts of the additive components are in percent by weight.

TABLE 1

Formulations

| Components | Comparative 1 | Example 1 | Example 2 |
|---|---|---|---|
| Sample 1 | 25 | — | — |
| Sample 2 | — | 25 | 25 |
| Aromatic Solvent | 67 | 67 | 65 |
| Acylated Nitrogen Compound* | 3 | 3 | 5 |
| 2-ethylhexanol | 5 | 5 | 5 |
| Kinematic Viscosity @ −29° C. | 18.5 $mm^2/s$ | 19 $mm^2/s$ | 22.9 $mm^2/s$ |

*Note:
reaction product of hexadecyl succinic anhydride and dimethyl ethanolamine
Note:
all values in Table 1 are given in weight percent unless indicated otherwise.

TABLE 2

Test Results (storage stability data)

| | Comparative 1 | Example 1 | Example 2 |
|---|---|---|---|
| 1 DAY RATING (RTG = Rating) | | | |
| 1 DAY RTG @ 0 C. | | C | C |
| 1 DAY RTG @ −18 C. | | C | C |
| 1 DAY RTG @ −29 C. | C/H/F | C | C |
| 1 DAY RTG @ −40 C. | | C/H/X | C |
| 7 DAY RATING | | | |
| 7 DAY RTG @ 0 C. | | C | C |
| 7 DAY RTG @ −18 C. | | C | C |
| 7 DAY RTG @ −29 C. | C/H/F | C | C |
| 7 DAY RTG @ −40 C. | | Z/H | Z/S |
| 14 DAY RATING | | | |
| 14 DAY RTG @ 0 C. | | C | C |
| 14 DAY RTG @ −18 C. | | C | C |
| 14 DAY RTG @ −29 C. | SLZ/H/F | C | C |
| 14 DAY RTG @ −40 C. | | Z | Z |
| 21 DAY RATING | | | |
| 21 DAY RTG @ 0 C. | | C | C |
| 21 DAY RTG @ −18 C. | | C | C |
| 21 DAY RTG @ −29 C. | Z/H/F | C | C |
| 21 DAY RTG @ −40 C. | | Z/H/X | Z/H/X |

Key
C = Clear;
Z = Hazy;
SLZ = Slightly Hazy;
X = Crystals;
N = T = Trace Precipitate;
L = Light Precipitate;
M = Medium Precipitate;
H = Heavy Precipitate;
F = Flocculent;

The result of the data in Table 2 show that compositions of the present invention (see Examples 1 and 2), which have a monounsaturated fatty acid content of less than about 45% by weight show improved storage stability compared to a commercial available composition (see Comparative 1), which has a monounsaturated fatty acid content greater than 45% by weight.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What we claim:

1. A homogenous additive composition comprising:

(a) fatty acid;

(b) a compatibilizer mixture; and (c) an aromatic solvent wherein the fatty acid has a monounsaturated fatty acid content of less than 45% by weight; and wherein the compatibilizer mixture comprises a mixture of a 1 to 10 carbon atom alcohol and the reaction product of an alkyl succinic anhydride derived from an olefin have 4 to 18 carbon atoms and an alkanolamine; and wherein the additive composition has kinematic viscosity of less than 100 $mm^2/s$ at −29° C.

2. The homogenous additive composition of claim 1, wherein the fatty acid comprises less than 45% by weight of oleic acid.

3. The homogenous additive composition of claim 1, wherein the alcohol of the compatibilizer mixture is 2-ethylhexanol.

4. The homogenous additive composition of claim 1, wherein the aromatic solvent has an aromatic content of greater than 80% by weight.

5. A fuel composition comprising:

(a) a liquid fuel;

(b) fatty acid;

(c) a compatibilizer mixture; and (d) an aromatic solvent wherein the fatty acid has a monounsaturated fatty acid content of less than 45% by weight; and wherein the compatibilizer mixture comprises a mixture of a 1 to 10 carbon atom alcohol and the reaction product of an alkyl succinic anhydride derived from an olefin have 4 to 18 carbon atoms and an alkanolamine; and wherein the additive composition has kinematic viscosity of less than 100 $mm^2/s$ at −29° C.

6. The homogenous additive composition of claim 1, wherein the fatty acid has a monounsaturated fatty acid content of less than 35% by weight.

7. The fuel composition of claim 5, wherein the fuel is diesel fuel.

8. The homogenous additive composition of claim 1, wherein the fatty acid has a monounsaturated fatty acid content from 10% to less than 45% by weight.

9. The fuel composition of claim 5, wherein the fatty acid has a monounsaturated fatty acid content from 10% to less than 45% by weight.

10. The homogenous additive composition of claim 1, wherein the fatty acid has the formula R—COOH where R is hydrocarbyl group containing 14 to 22 carbon atoms.

11. The fuel composition of claim 5, wherein the fatty acid has the formula R—COOH where R is hydrocarbyl group containing 14 to 22 carbon atoms.

12. The fuel composition of claim 5, wherein the liquid fuel is selected from the group consisting of a hydrocarbon fuel, a non-hydrocarbon fuel, or a mixture thereof;

wherein the hydrocarbon fuel is selected from the group consisting of gasoline as defined by ASTM specification D4814 or a diesel fuel as defined by ASTM specification D97; and wherein the non-hydrocarbon fuel is selected from the group consisting of an alcohol, an ether, a ketone, an ester of a carboxylic acid, a nitroalkane, or a mixture thereof.

* * * * *